US007172092B2

(12) United States Patent
Yang et al.

(10) Patent No.: US 7,172,092 B2
(45) Date of Patent: Feb. 6, 2007

(54) UPRIGHT CONTAINER FOR STORING AND DISPENSING BAGS

(75) Inventors: Frank Yang, Rancho Palos Verdes, CA (US); Joseph Sandor, Santa Ana Heights, CA (US); Myk Wayne Lum, Irvine, CA (US); Adam C. Wade, Rancho Santa Margarita, CA (US)

(73) Assignee: Simplehuman LLC, Torrance, CA (US)

( * ) Notice: Subject to any disclaimer, the term of this patent is extended or adjusted under 35 U.S.C. 154(b) by 13 days.

(21) Appl. No.: 11/084,207

(22) Filed: Mar. 18, 2005

(65) Prior Publication Data

US 2005/0199641 A1 Sep. 15, 2005

Related U.S. Application Data

(63) Continuation-in-part of application No. 10/623,998, filed on Jul. 21, 2003, now Pat. No. 7,044,329, and a continuation-in-part of application No. 29/200,976, filed on Mar. 5, 2004, now Pat. No. Des. 507,715.

(51) Int. Cl.
*A47K 10/24* (2006.01)

(52) U.S. Cl. ..... 221/45; 206/554; 206/494; 206/449; 206/812; 221/33; 221/63; 221/48; 221/303

(58) Field of Classification Search ..... 221/33, 221/45, 48, 61, 63, 303; 206/494, 554
See application file for complete search history.

(56) References Cited

U.S. PATENT DOCUMENTS 3,381,853 A * 5/1968 Ferris et al. ..... 221/63
4,537,330 A 8/1985 Gelbard
4,574,981 A 3/1986 Jewett
4,623,073 A 11/1986 Hansen
5,002,200 A 3/1991 Hunt
5,042,687 A 8/1991 McKinley
D329,344 S 9/1992 Carillo
5,211,308 A * 5/1993 Decker et al. ..... 221/63
5,285,927 A 2/1994 Pruitt
D358,325 S 5/1995 McNaughton
5,511,691 A 4/1996 West, Jr.
5,794,815 A * 8/1998 Carlson et al. ..... 221/45
D397,566 S 9/1998 Choiniere et al.
6,003,723 A * 12/1999 Morand ..... 221/44
D419,010 S 1/2000 Hansen et al.
6,354,462 B1 * 3/2002 Conran et al. ..... 221/45
6,401,971 B1 6/2002 Edwards et al.
D475,873 S 6/2003 Mello (Continued)

*Primary Examiner*—Gene O. Crawford
(74) *Attorney, Agent, or Firm*—Liu & Liu

(57) ABSTRACT

A container for storing and dispensing plastic bags and process for manufacturing the same. The container includes a front panel extending from the top of the container to the bottom of the container and having a substantially smooth surface with no sharp bents. The container includes a funnel-shaped aperture for facilitating insertion of the plastic bags into the container in a compact and collapsed form. One embodiment of the container has a flat profile that allows the container to be mounted to a vertical surface in a space-saving manner and that helps minimize entanglement as more bags are inserted into the container. The container also includes an access opening for dispensing the plastic bags. Another embodiment of the container is a free-standing structure having a base that can be rested on a horizontal surface.

19 Claims, 12 Drawing Sheets

U.S. PATENT DOCUMENTS 6,585,130 B2 * 7/2003 Turbett et al. ..... 221/45
6,666,416 B1 12/2003 McAllister
6,869,041 B1 * 3/2005 Allegre et al. ..... 242/593
6,920,999 B2 * 7/2005 Taylor et al. ..... 221/154
7,040,566 B1 * 5/2006 Rodrian et al. ..... 242/563
2002/0145004 A1 10/2002 Bennett et al.
2003/0168378 A1 * 9/2003 Au ..... 206/736
2005/0056656 A1 * 3/2005 Hochtritt et al. ..... 221/45

* cited by examiner

UPRIGHT CONTAINER FOR STORING AND DISPENSING BAGS

CROSS REFERENCE

This application claims priority and is a continuation-in-part of U.S. patent application Ser. No. 10/623,998, filed on Jul. 21, 2003 now U.S. Pat. No. 7,044,329, and U.S. patent application Ser. No. 29/200,976, filed on Mar. 5, 2004, now D.507,715. These applications are fully incorporated by reference as if fully set forth herein.

FIELD OF THE INVENTION

The present invention relates to a container for storing and dispensing bags, and more particularly to plastic bags.

BACKGROUND OF THE INVENTION

Plastic bags are commonly used to package various types of consumer goods, such as food and related products, for ease in transporting the goods. Consumers then often save their plastic bags for reuse as trash bags, for example. However, storage of used plastic bags is often cumbersome. Also, it is difficult to maintain plastic bags in a compact form due to its resilient nature. As such, used plastic bags require more storage space than paper bags.

Containers have been developed to facilitate storage of used plastic bags. U.S. Pat. No. 5,002,200 to Hunt discloses a container for used plastic bags. The container is not aesthetically appealing and occupies a relatively larger footprint for a given container volume due to its cuboid configuration. The larger footprint competes for scarce storage space in a storage cabinet, for example. The container includes a small opening at the top of the container for access and dispensing of the bags. As such, before a bag can be placed into the container for storage, the user must manipulate the bag into a compact form to fit through the small opening. This can be cumbersome and difficult for some users. When the container is relatively empty, as bags are inserted into the container, they tend to expand to fill the container, and subsequently inserted bags tend to entangle with each other. As a result, when a user pulls to remove a bag from the container, more than one bag may be dispensed.

It is therefore desirable to have a container that is of a compact space-saving profile, that is aesthetically appealing, as well as efficient with respect to storage space.

SUMMARY OF THE INVENTION

The present invention is directed to a container for storing and dispensing various types of plastic bags. In one aspect of the present invention, the container is configured to facilitate storage of the plastic bags in an organized fashion and to minimize entanglement of the plastic bags with each other. In one embodiment, the container includes a funnel-shaped aperture. The wider end of the aperture confronts the outer side of the container, and the narrower end is disposed within the container. The funnel-shaped aperture facilitates collapsing the plastic bags into a compact form for insertion of the plastic bags into the container. In some embodiments, the container is configured having a flat profile. As more bags are inserted into the container, the flat profile of the container facilitates stacking the bags in their collapsed form. As such, entanglement of the bags is minimized. In certain embodiments, the container includes means for mounting the container to a vertical surface, such as underneath or inside a cabinet. The flat profile of the container also minimizes the space occupied by the container when mounted underneath the cabinet, for instance.

In another aspect of the invention, the container includes a substantially smooth front panel extending from the top of the container to the bottom of the container. In some embodiments, the front panel of the container has no sharp bents. In certain embodiments, the front panel is made from a sheet of metal.

In a further aspect of the present invention, the container includes a metal front panel, extending from the top of the container to the bottom of the container and having an access opening at the top, and a protective guard for the access opening.

The container can include components made from either metal or plastic. In still a further aspect of the invention, the container includes means for mounting the metallic components to the plastic components. In one embodiment, the container includes a metal front panel, a rear plastic base, and a mounting member. The mounting member provides a support structure for fasteners to attach the metal front panel to the plastic base.

In still a further aspect of the invention, the components of the container are designed for improved manufacturability. In some embodiments, the container includes a one-piece rear and side panel whereby the side-panels are foldable with respect to the rear panel. The one-piece rear and side panel is made from a plastic. At the junctions of the rear and side panels, the plastic material is thinner and/or scored, which allows the side panels to hingedly fold with respect to the rear panel.

Further improvements to the foregoing include an upright free-standing container for storing and dispensing bags, wherein (a) the container having a smooth unitary panel extending from top to front of the container; (b) the container having a smooth unitary structure defining rear and side panels; (c) the container having a one-piece plastic front panel and a one-piece metal panel for rear and sides; (d) the plastic front panel and the metal side and rear panel are held together with a minimum number of separate fasteners; and (e) the front panel having an integral or unitary structure that defines the funnel-shaped aperture.

BRIEF DESCRIPTION OF THE DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

DETAILED DESCRIPTION OF THE PREFERRED EMBODIMENTS

This invention is described below in reference to various embodiments with reference to the figures. While this invention is described in terms of the best mode for achieving this invention's objectives, it will be appreciated by those skilled in the art that variations may be accomplished in view of these teachings without deviating from the spirit or scope of the invention.

The present invention is directed to a container for storing and dispensing various types of bags. The container is particularly suited for storing and dispensing plastic bags, including, but not limited to, new or used bags made from polyethylene, such as those used in the grocery industry for packaging products for ease in carrying. For purposes of illustrating the principles of the present invention and not by limitation, the present invention is described by reference to embodiments directed to a container for storing and dispensing used plastic bags.

Figure 1:
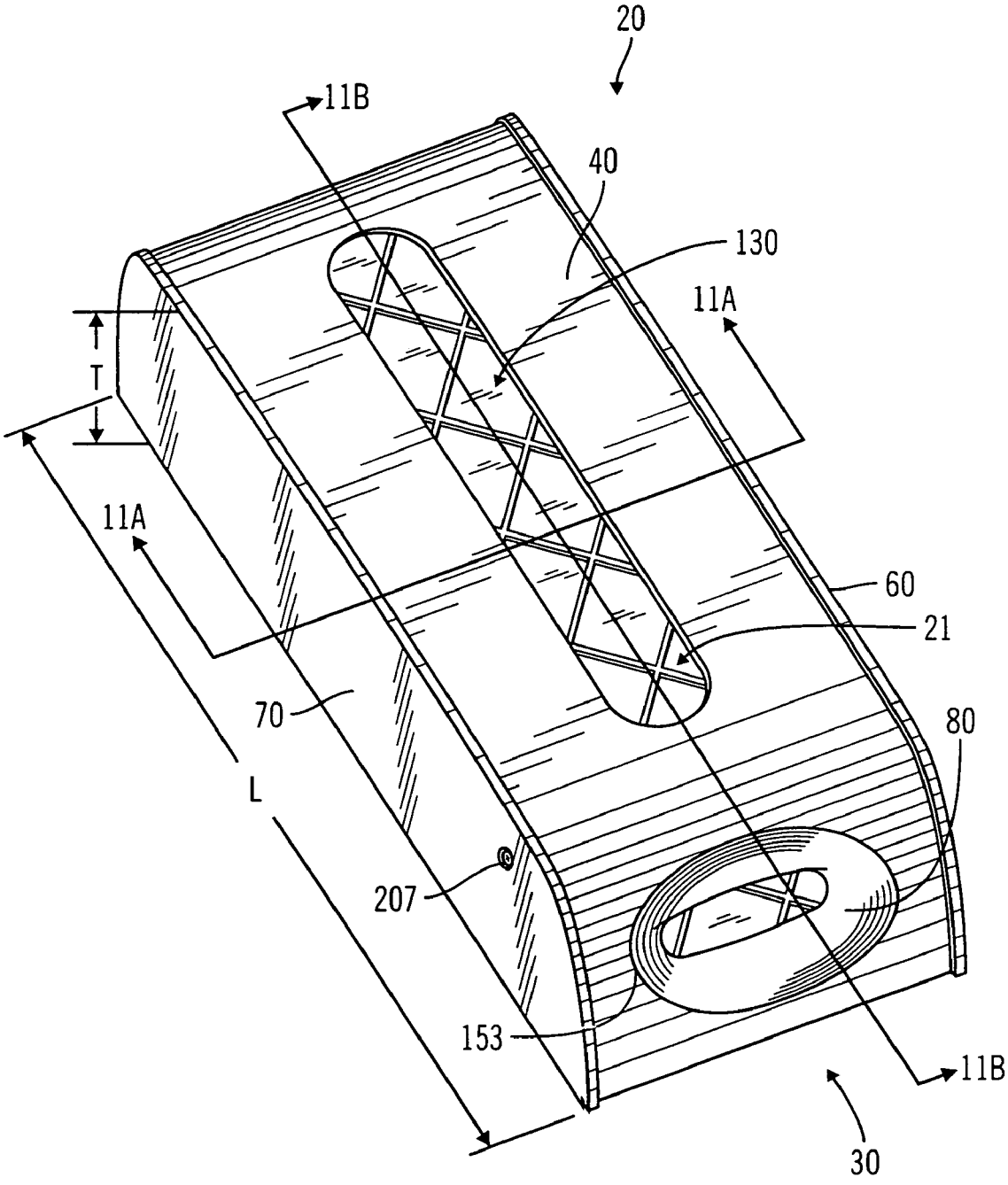
FIG. 1 is a perspective view of a container for storing and dispensing plastic bags in accordance with one embodiment of the present invention.
Figure 4:
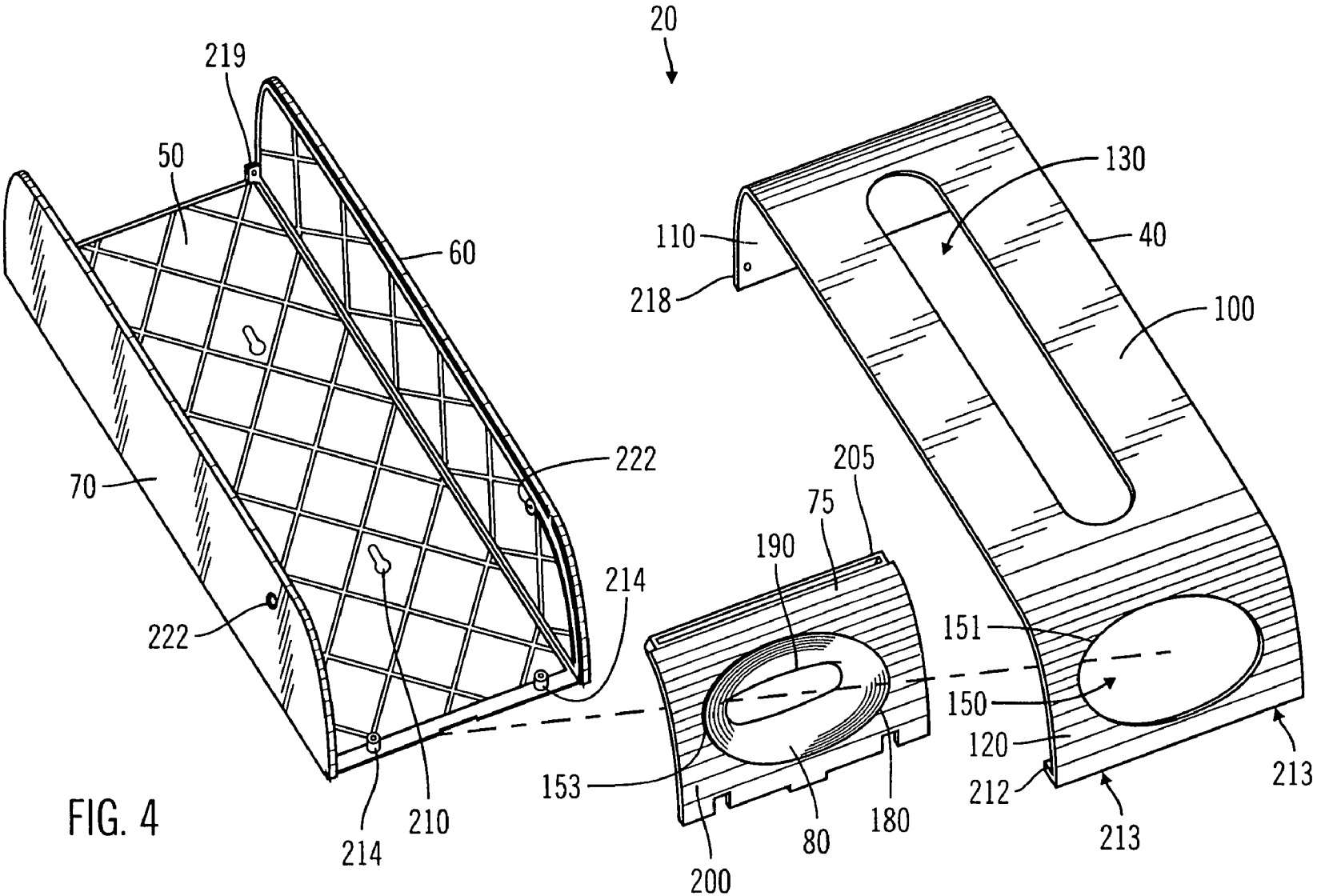
FIG. 4 is an exploded view of the container shown in FIG. 1.

FIG. 1 is a perspective view of a container 20 for storing and dispensing plastic bags in accordance with one embodiment of the present invention. The container 20 provides a housing for storing the plastic bags. Arrow 30 shows the orientation of the container 20 from top to bottom when the container 20 is mounted against a vertical surface. FIG. 4 is an exploded view of the container 20 shown in FIG. 1. The container 20 includes a front panel 40, a rear panel or base 50, two identical side panels 60 and 70, and a bracket 75 having a funnel-shaped aperture 80. The container 20 defines a storage space 21.

Figure 5:
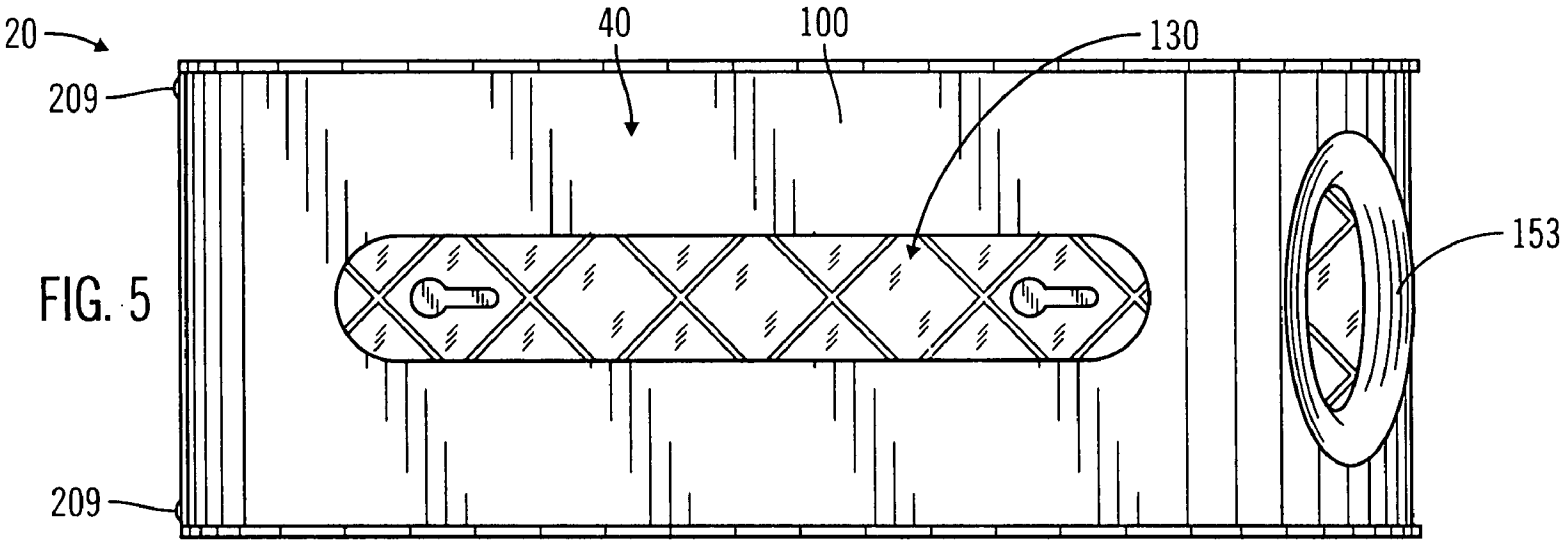
FIG. 5 is a front view of the container shown in FIG. 1.

Referring to FIG. 4, the front panel 40 extends from top of the container 20 to the bottom of the container 20. The front panel 40 includes three sections: a middle section 100, a first end section 110 and a second end section 120. The middle section 100 of the front panel 40 defines the front or forward side of the container 20. FIG. 5, which is a front view of the container 20, shows the middle section 100 of the front panel 40. The middle section 100 has an opening 130 sized and shaped to facilitate accessing and dispensing the plastic bags housed within the container 20. The opening 130 has an elongated shape, e.g., an elongated oval shape.

Figure 10:
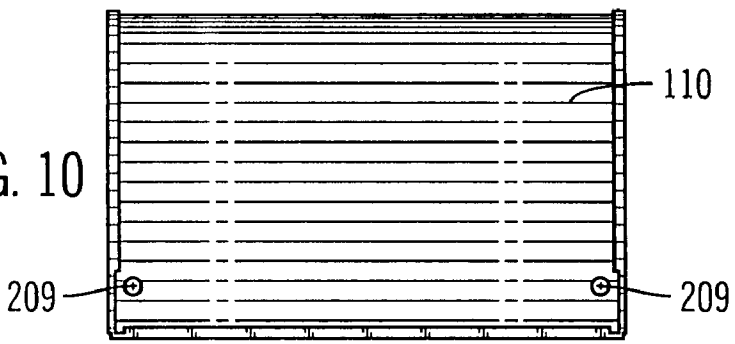
FIG. 10 is a bottom view of the container shown in FIG. 1.

Referring back to FIG. 4, the first end section 110 is oriented substantially perpendicular to the middle section 100 and defines the bottom side of the container 20. FIG. 10 is a bottom view of the container 20 shown in FIG. 1, which more clearly shows the first end section 110 of the front panel 40. The first end section 110 is bent with respect to the middle section 100 such that bottom bend 140 is substantially smooth.

Figure 9:
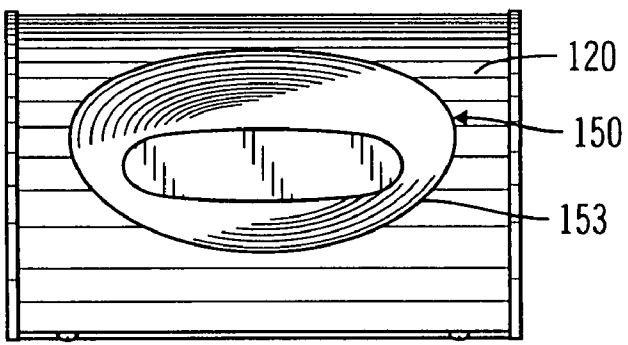
FIG. 9 is a top view of the container shown in FIG. 1.

Referring back to FIG. 4, the second end section 120 has a substantially smooth curved shape and defines the top side of the container 20. The second end section 120 has an opening 150 sized and shaped to facilitate insertion of plastic bags into the container 20. FIG. 9 is a top view of the container 20 showing the second end section 120 of the front panel 40. A protective guard 153 can be included at the opening 150 to provide a safety measure against sharp edges that can cut a user's finger or hands.

The front panel 40 can be made from a smooth sheet of metal, such as stainless steel, which provides the container with substantial rigidity and aesthetic appeal. Alternatively, the front panel 40 can be made from a rigid plastic material or a pliable plastic that can be bent to form a relatively rigid structure of the middle and end sections.

Figure 2:
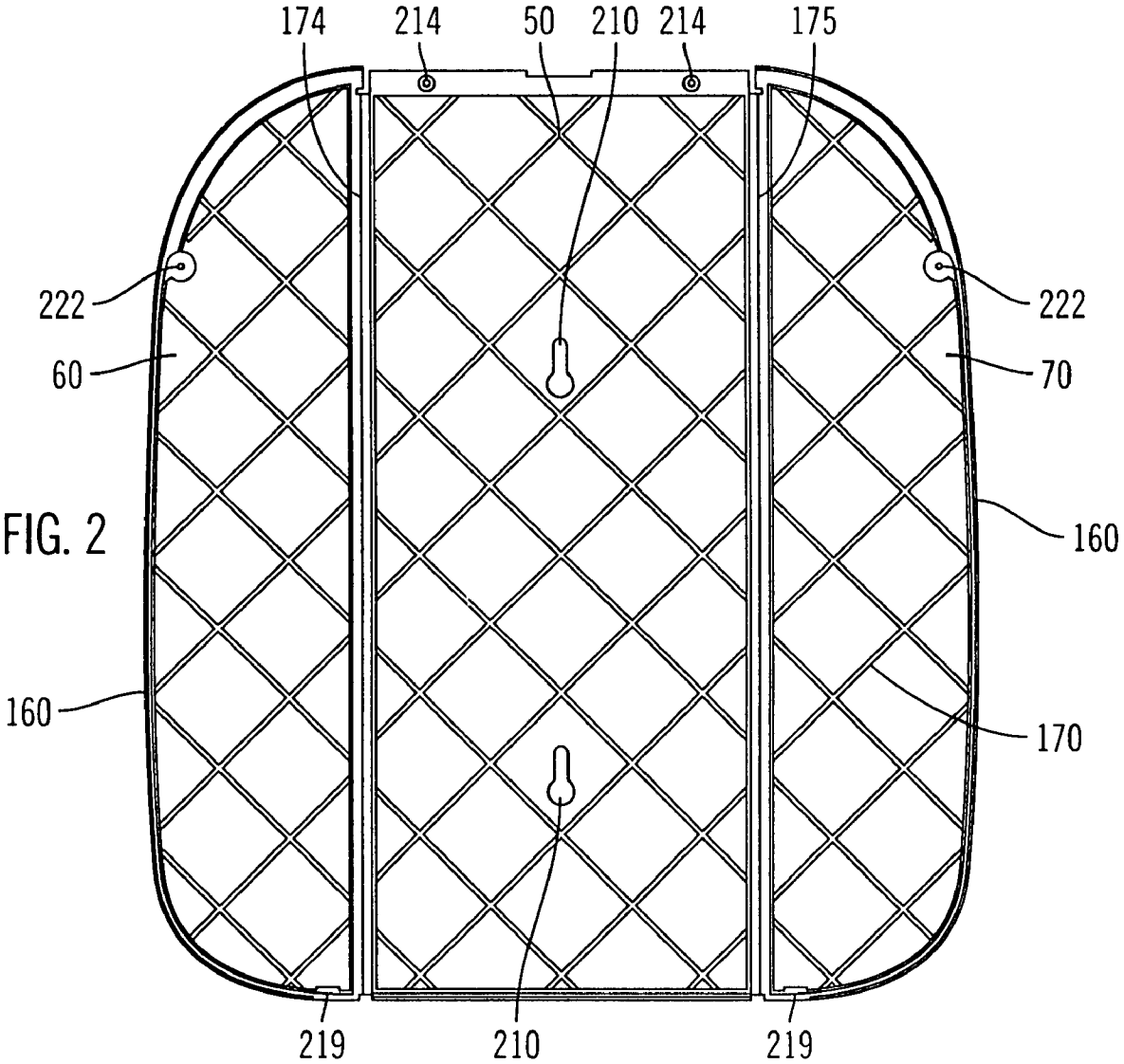
FIG. 2 is a schematic view of inner surfaces of a rear panel and side panels of the container shown in FIG. 1.
Figure 3:
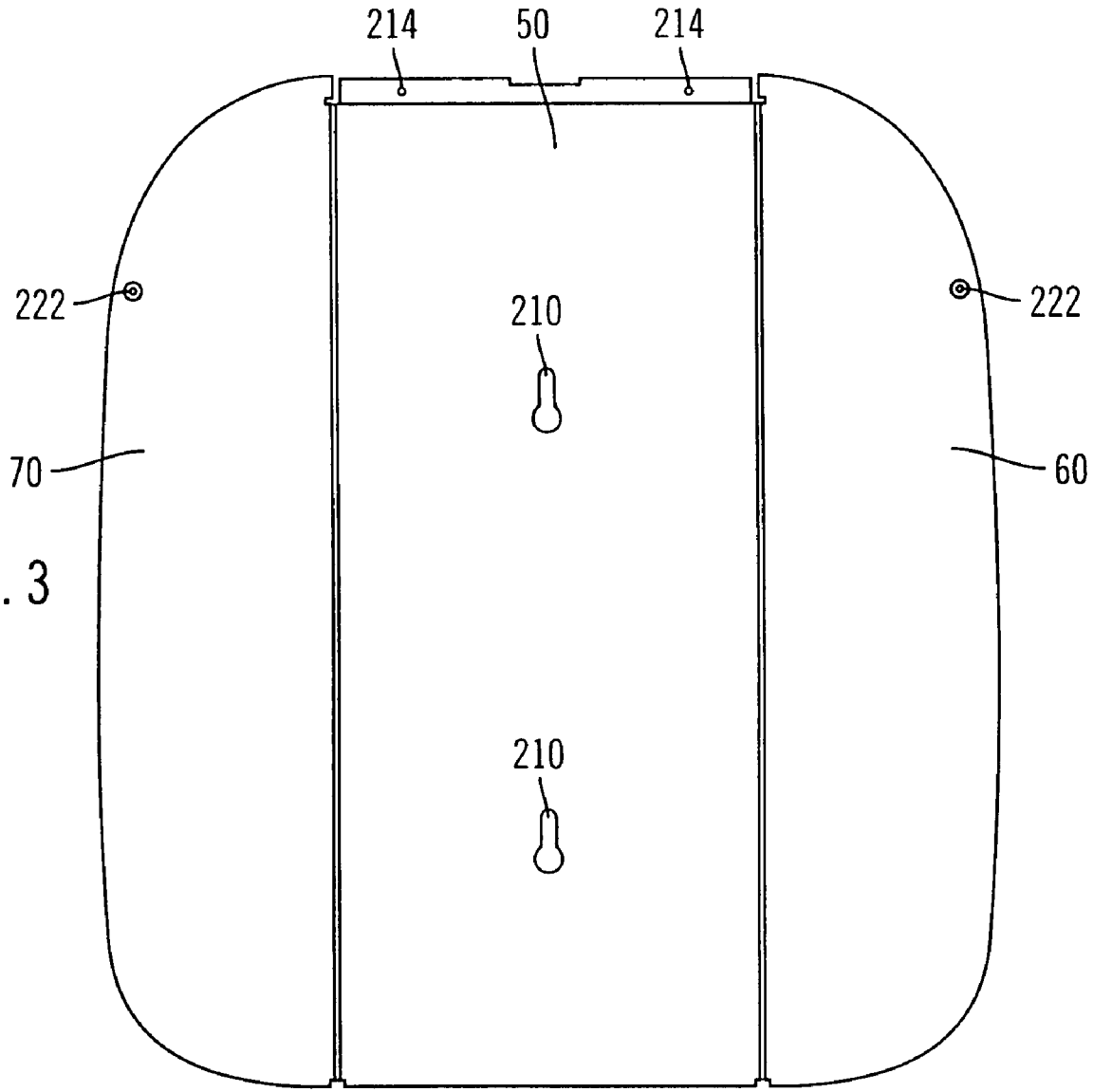
FIG. 3 is a schematic view of outer surfaces of the rear panel and the side panels of the container shown in FIG. 1.
Figure 7:
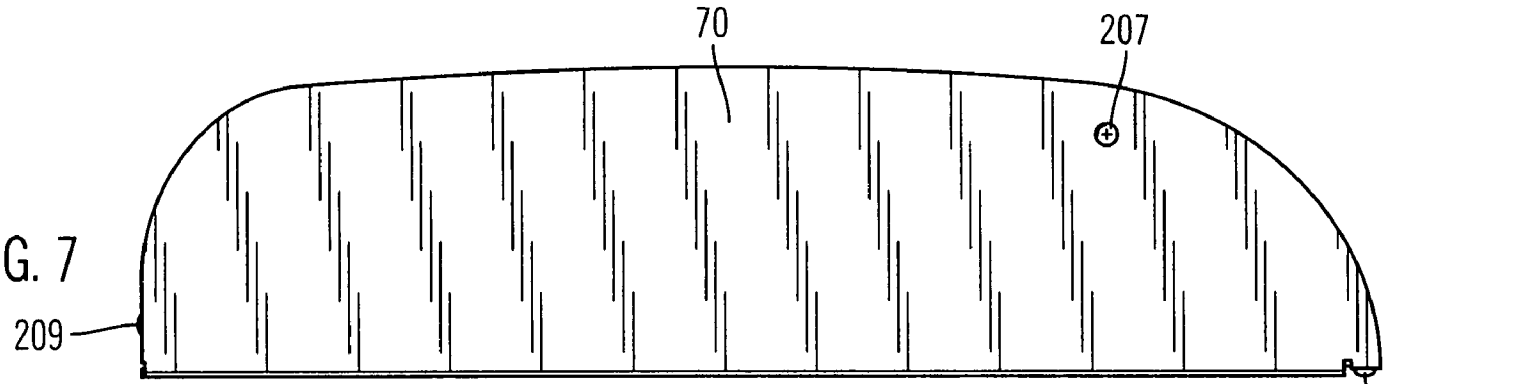
FIGS. 7 and 8 are side views of the container shown in FIG. 1.
Figure 8:
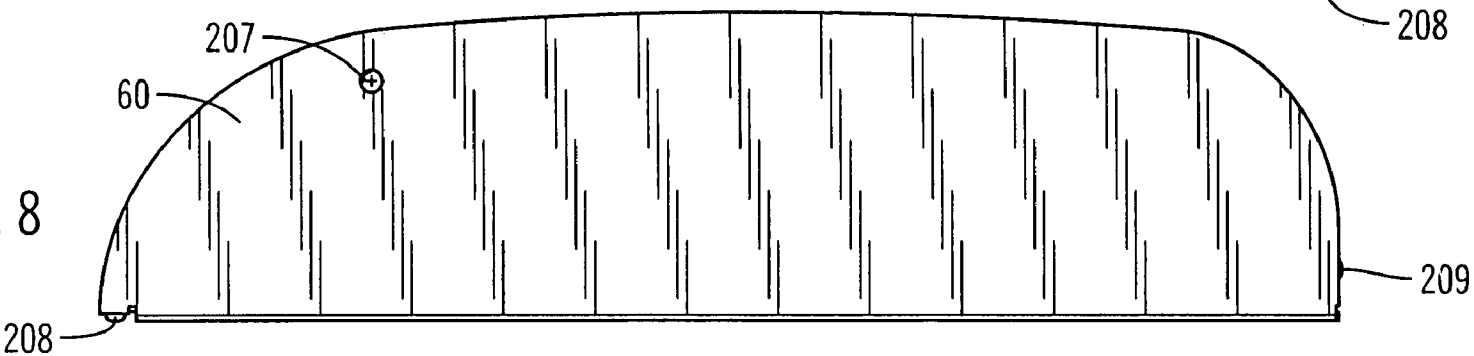
Figure 11A:
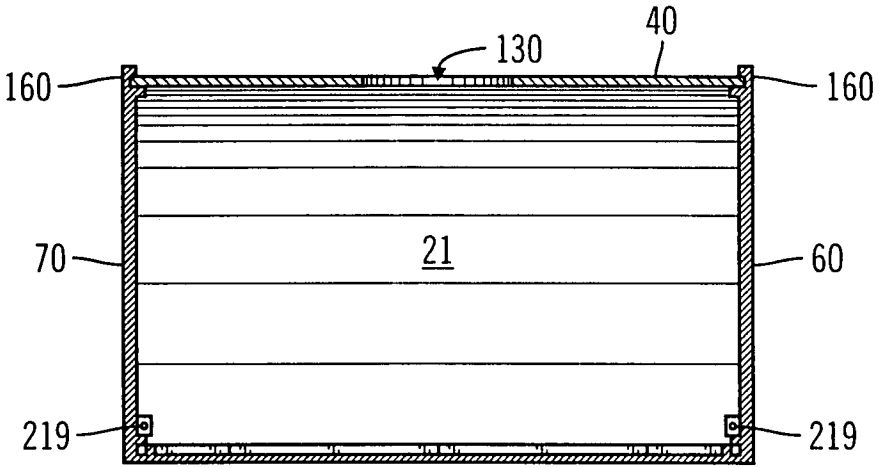
FIG. 11A is a sectional view of the container shown in FIG. 1, taken along line 11A—11A.
Figure 11B:
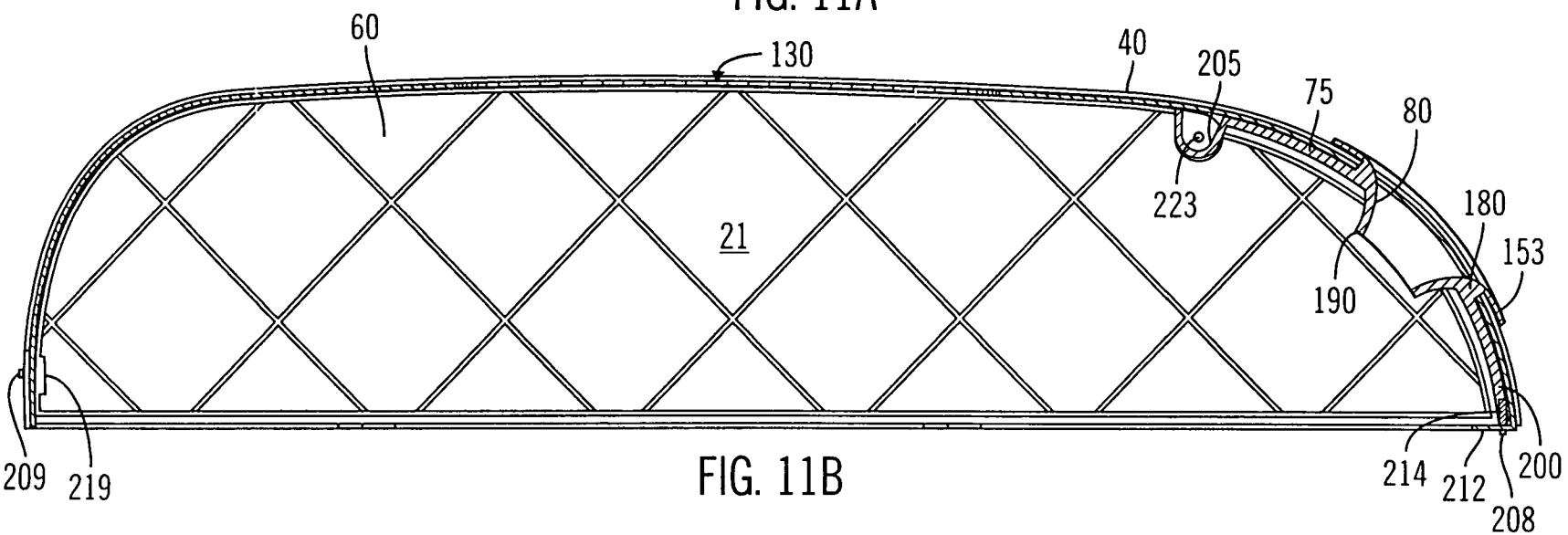
FIG. 11B is a sectional view of the container shown in FIG. 1, taken along line 11B—11B.

Referring to FIG. 4, the side panels 60 and 70 are attached to the rear panel or base 50 such that the side panels 60 and 70 are oriented substantially perpendicular with respect to the rear panel 50. The rear panel 50 and the side panels 60 and 70 can be provided as a monolithic or a one-piece structure, with the side panels 60 and 70 hingedly attached to the bottom panel 50. FIG. 2 is a schematic view of the inner surfaces of the one-piece rear and side panels 50, 60 and 70. FIG. 3 is a schematic view of the outer surfaces of the rear and side panels 50, 60 and 70. FIGS. 7 and 8 are side views of the container 20 showing the side panels 70 and 60, respectively. The one-piece structure can be made from a rigid material (e.g., plastic) that provides sufficient rigidity for supporting the front panel 40 and for housing the plastic bags. As shown in FIG. 2, the inner surfaces of the rear and side panels 50, 60 and 70 can also be provided with ribs 170 for providing additional rigidity to the container 40. At junctions 174 and 175 of the rear and side panels 50, 60 and 70, the plastic material has a reduced thickness and/or is scored so that the side panels 60 and 70 can hingedly fold with respect to the rear panel 50. The side panels 60 and 70 can be folded from a flat position as shown in FIGS. 2 and 3 to an upright position as shown in FIGS. 1 and 4. The side panels 60 and 70 include grooves 160 extending along the periphery of the side panels 60 and 70. Depending upon the particular requirements of the application, the grooves 160 can extend along substantially the entire periphery or only portions of the periphery. The grooves 160 are adapted to receive side edges of the front panel 40, facilitating attaching the front panel 40 to the side panels 60 and 70. FIGS. 11A and 11B are sectional views of the container 20 taken along lines 11A—11A and 11B—11B respectively. FIGS. 11A and 11B show the front panel 40 assembled to the side panels 60 and 70 within the grooves 160. Alternatively, the rear panel 50 and the side panels 60 and 70 can be provided as separate structures that can be attached together by fastening means well known in the art. Also, the panels 50, 60 and 70 can be made from a sheet of metal, such as stainless steel.

Referring to FIGS. 4 and 11B, the bracket 75 has an aperture 80 that facilitates insertion of plastic bags into the container 20. The aperture 80 has a funnel shape having a wide end 180 facing the outside of the container 20, and a narrow end 190 facing the storage space 21. The bracket 75 includes support structure 200 for positioning the aperture 80 in alignment with the opening 150. The bracket 75 is disposed at about the second end section 120 of the front panel 40. As a bag passes from the wide end 180 of the aperture 80 through the narrow end 190 and into the storage space 21 of the container 20, the aperture 80 manipulates and collapses the bag into a compact form. As such, the plastic bags can be more efficiently stored within the container 20, allowing more plastic bags to fit within the storage space 21. It is understood that the aperture 80 can have other shapes that facilitate collapsing the plastic bags into a compact form. In an alternative embodiment (not shown), the front panel is provided with a funnel-shaped opening in place of the opening 150.

The bracket 75 also provides a mounting structure for the metal front panel 40 and the plastic side panels 60 and 70 comprising a mounting member 205. The mounting member is adapted to receive fasteners, such as screws 207. The side panels 60 and 70 include through holes 222 aligned with screw holes 223 of the mounting member 205. The screws 207 attach the plastic side panels 60 and 70 to the mounting member 205. Alternatively, the side panels can be attached to the mounting member by other fastening means such as an adhesive material. Once attached to the mounting member 205, the side panels 60 and 70 clamp the side edges of the metal front panel 40 within the grooves 160. The side panels clamp the front panel in place with respect to the side panels. The mounting member 205 allows for mounting the plastic components (i.e., the side panels 60 and 70) of the container to the metal components (i.e., the front panel 40). As such, no external bent mounting tabs are required to attach the front panel 40 to the side panels 60 and 70, which improves the aesthetic quality of the container 20 (i.e., no unsightly tabs). In alternate embodiments (not shown), the mounting member is provided as a structure separate from the bracket.

Figure 6:
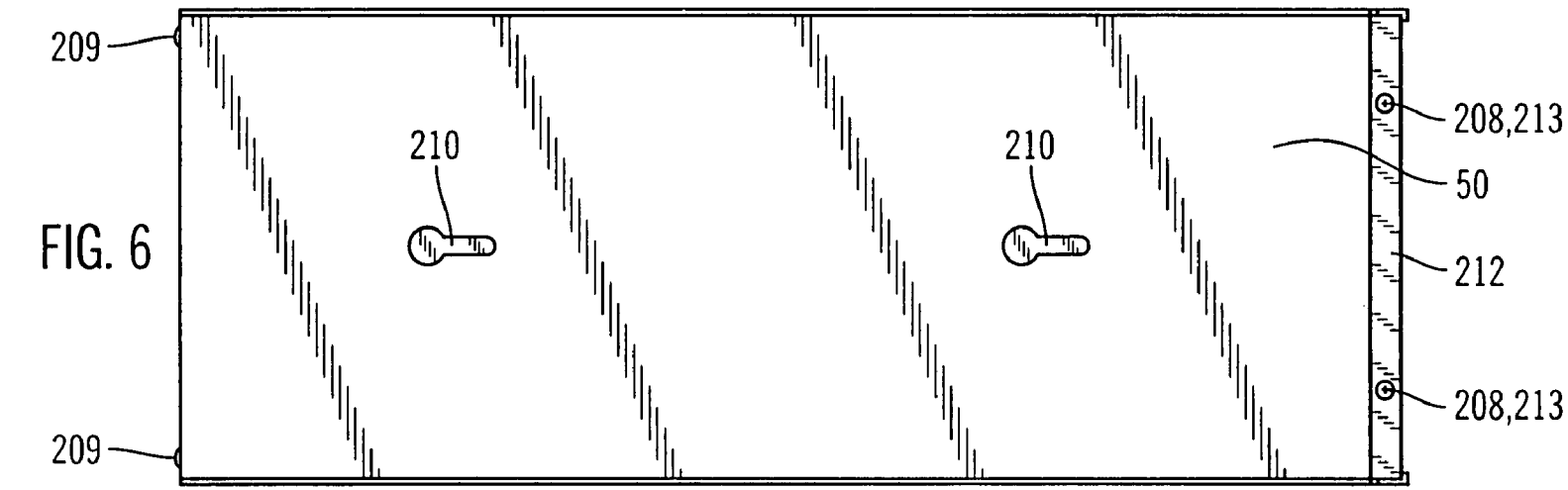
FIG. 6 is a rear view of the container shown in FIG. 1.

The container 20 includes means well known in the art for mounting the container 20 to a wall. FIG. 6 is a rear view of the container 20 shown in FIG. 1. The rear panel 50 is provided with slots 210 that are adapted to engage a hook, nail, screw, or other similar structures that is secured to the wall. The slots 210 allow the container to be mounted underneath a cabinet for example.

Referring back to FIG. 1, the container 20 has a length L and a thickness T. The container 20 has a relatively long length L with respect to its thickness T, giving the container 20 a relatively flat profile. When the container 20 is mounted in an area of limited space, such as underneath or inside a cabinet, the relatively flat profile of the container 20 allows the container 20 to occupy relatively less lateral space. Additionally, the flat profile of the container 20 facilitates storing the plastic bags in a stacked and organized fashion. As more plastic bags are inserted at the top opening 150 and through the aperture 80 into the container 20, the bags pass though the small thickness T of the container 20 on their way down to the bottom of the container 20. The small thickness T of the container 20 guides and channels the bags in an organized fashion so that the bags stack on top of each other in a collapsed form. As such, the flat profile of the container 20 helps minimize entanglement of the bags with each other.

The present invention is also embodied in a process for assembling the container 20 shown in FIG. 1. A step in the process is folding the side panels 60 and 70, along the scored junctions 174 and 175, from their flat positions to their upright positions. A further step is positioning the front panel 40 with respect to the side panels 60 and 70 such that the side edges of the front panel 40 are fitted within the grooves 160 of the side panels 60 and 70. The bracket 75 is positioned at the opening 150 of the front panel 40 such that the wide end 180 of the funnel-shaped aperture 80 faces the outside of the container 20 and the narrow end 190 faces the storage space 21. Yet a further step is clamping the side edges of the front panel 40 within the grooves 160 of the side panels 60 and 70. Clamping the front panel 40 involves attaching the side panels 60 and 70 to the mounting member 205 by one or more fasteners, such as the screws 207. When the side panels 60 and 70 are attached to the mounting member 205, the side panels 60 and 70 clamp the side edges of the front panel 40 so to maintain the side edges of the front panel 40 within the grooves 160 of the side panels 60 and 70. Additionally, the first and second end sections 110 and 120 of the front panel 40 can be fastened to the rear and side panels 50, 60 and 70 by one or more fasteners, such as screws 208 and 209. At the first end section 110 of the front panel 40 is a bent tab 212 having holes 213 aligned with cylindrical stubs 214 having holes for allowing the front panel 40 to be fastened to the rear panel 50 by the screws 208. The second end section 120 of the front panel 40 also includes holes 218 aligned with tabs 219 having holes for allowing the front panel 40 to be fastened to the side panels 60 and 70 by the screws 209.

In operation, the user inserts bags into the container 20 via the funnel-shaped aperture 80. As the bags pass from the wider end 180 of the aperture 80 through the narrower end 190, the funnel shape of the aperture 80 manipulates and collapses the bags into a compact form that allows the bags to fit compactly within the container 20. The user is not required to first manipulate the bags into a compact form before insertion into the container 20. Also, the flat profile of the container 20 aids in stacking the bags in an organized fashion so that there is minimal entanglement of the bags with each other. The user can dispense bags from within the container 20 by accessing the bags from the front access opening 130 at the front panel 40. The bags can be selectively dispensed from the container 20 since the bags are stored in a stacked and organized fashion.

Further improvements to the foregoing is exemplified by the embodiment of an upright free-standing container for storing and dispensing bags, wherein (a) the container having a smooth unitary panel extending from top to front of the container; (b) the container having a smooth unitary structure defining rear and side panels; (c) the container having a one-piece plastic front, panel and a one-piece metal panel for rear and sides; (d) the plastic front panel and the metal side and rear panel are held together with a minimum number of separate fasteners; and (e) the front panel having an integral or unitary structure that defines the funnel-shaped aperture. These structural features are illustrated in FIGS. 12 to 16.

Figure 12:
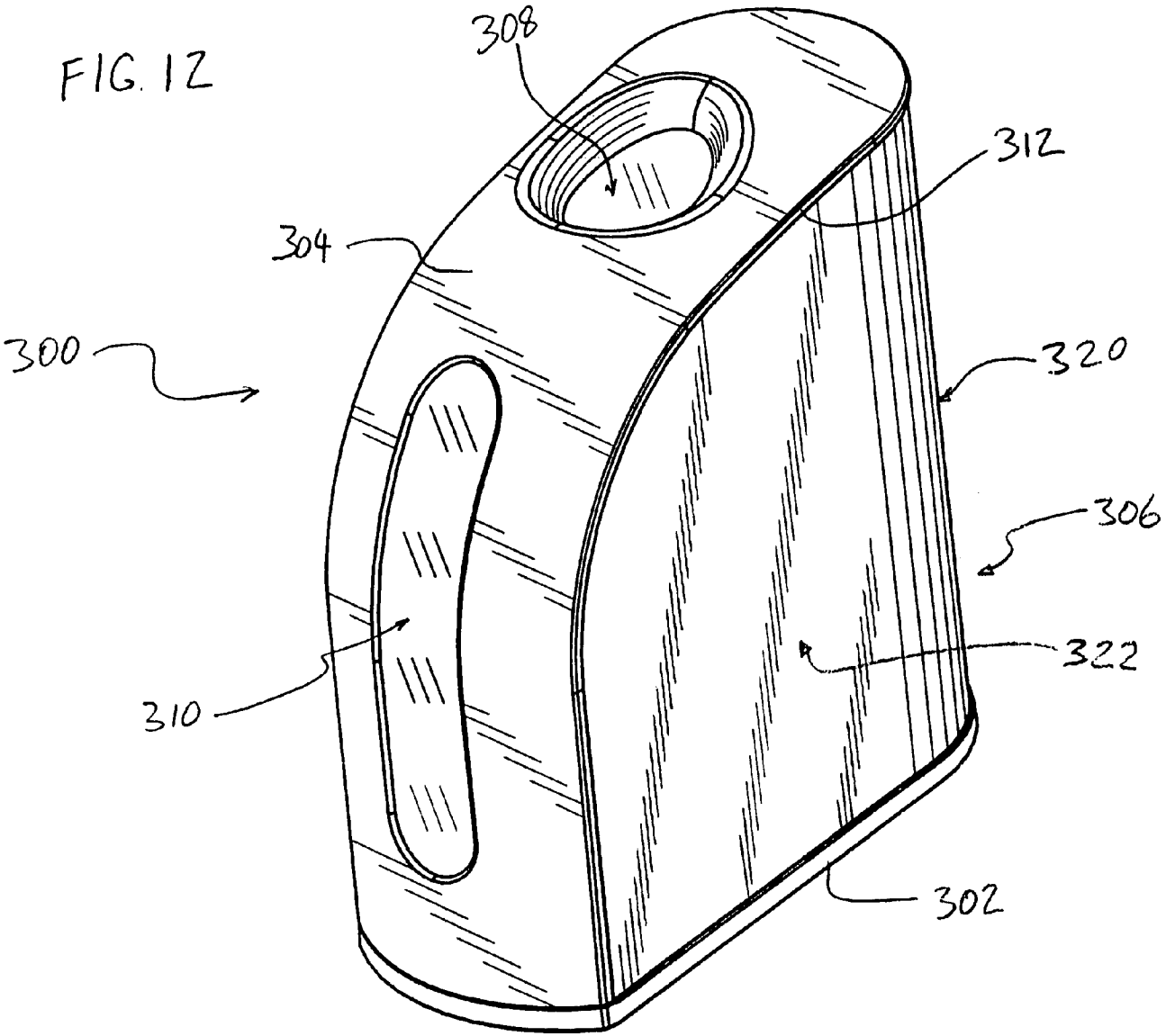
FIG. 12 is a perspective view of a container for storing and dispensing plastic bags in accordance with another embodiment of the present invention.

In this embodiment of FIG. 12, the container 300 has a free-standing upright structure. The container 300 comprises essentially the following separate components, including (a) a one-piece base 302, (b) a one-piece front panel 304, and (c) a one-piece rear panel 306. The front panel 304 extends from the top to the front of the container 300, including a funnel-shaped aperture 308 at the top and an elongated opening 310 at the front of the container 300. The purposes of the funnel-shaped aperture 308 and the elongated opening 310 are similar to the corresponding structures in the previous embodiment.

Figure 13:
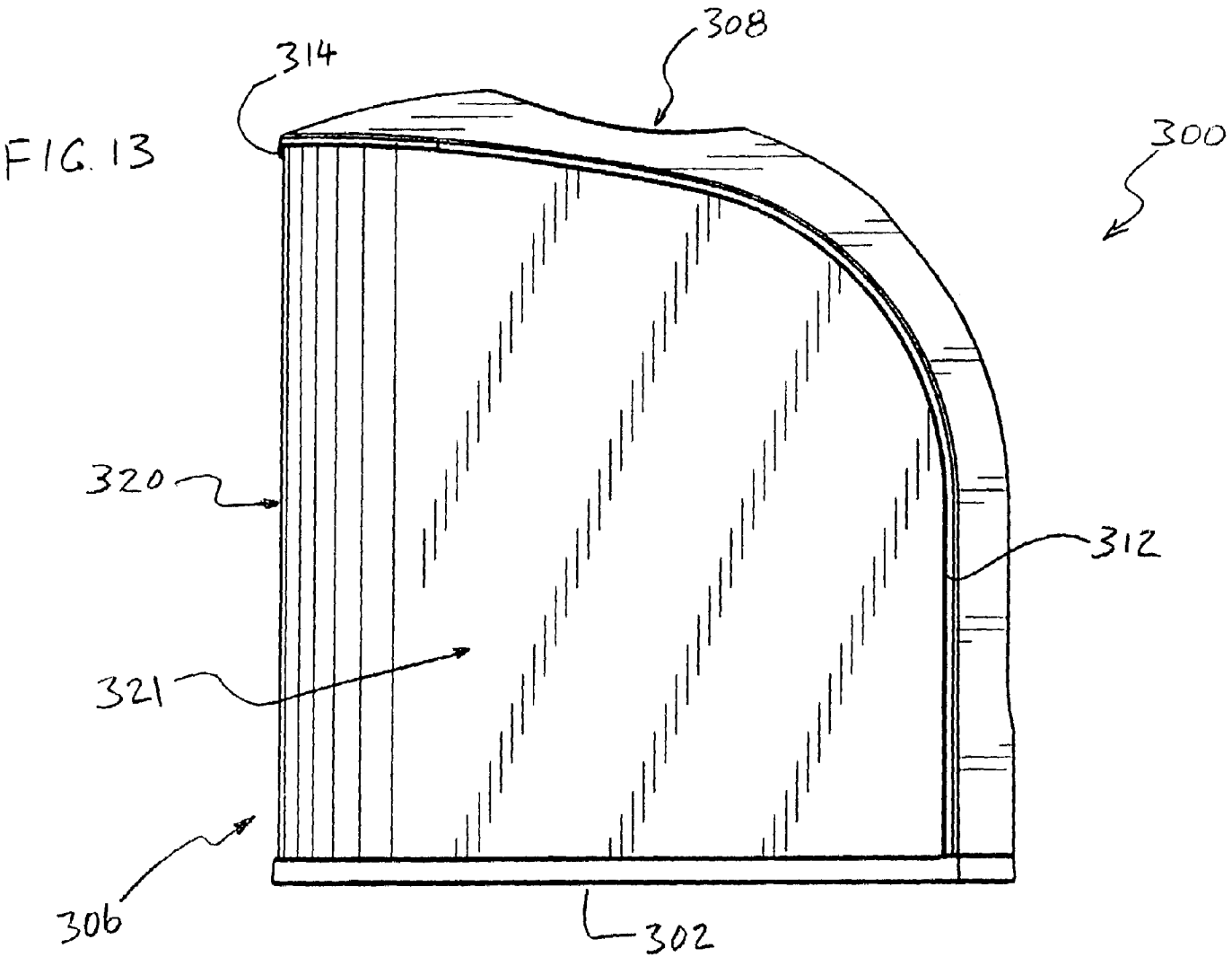
FIG. 13 is a side view of the container shown in FIG. 12.
Figure 14:
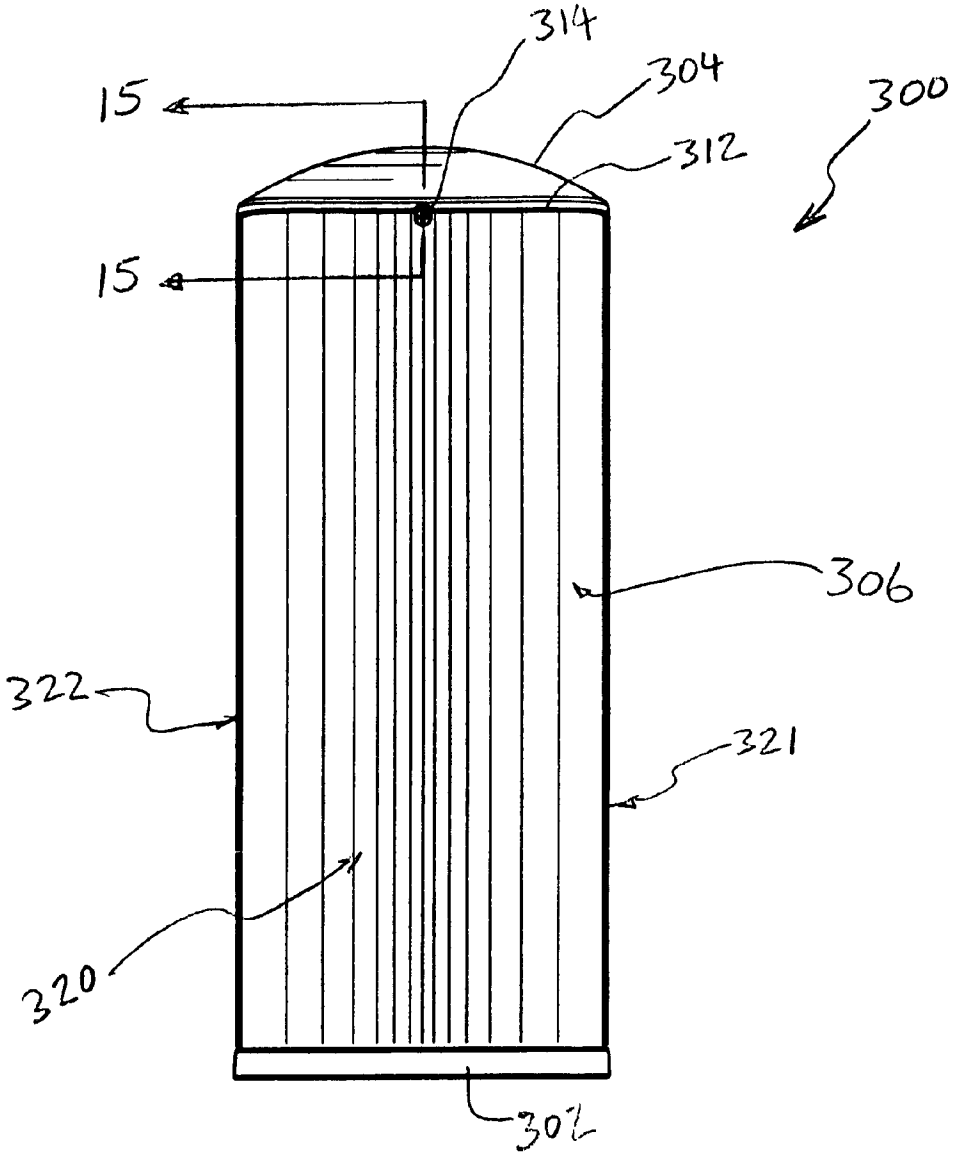
FIG. 14 is a rear view of the container shown in FIG. 12.
Figure 15:
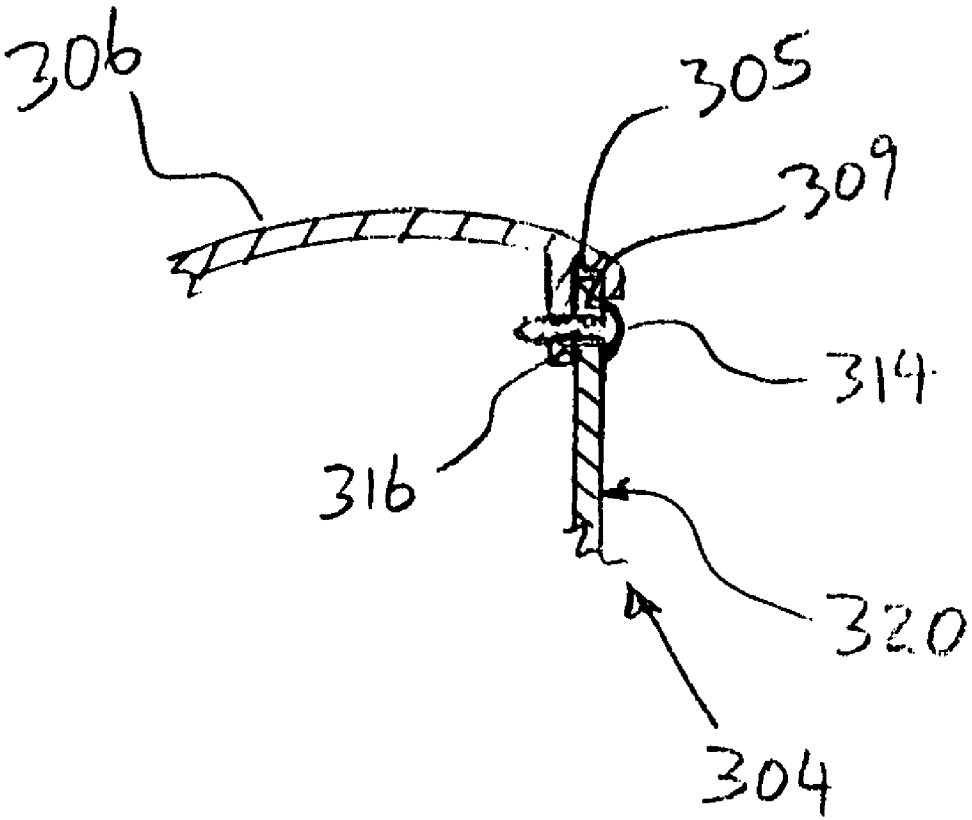
FIG. 15 is a sectional view of the container shown in FIG. 14, taken along line 15—15.

In one embodiment, this front panel 304 is made of a thin rigid plastic material, which may be textured or coated or painted to provide a desirable finish. As illustrated in FIGS. 12 and 13, the front panel 304 has a convex structure, towards the outside of the container 300. Regardless of surface finish, the front panel 304 is generally smooth, i.e., without structural seams, joints or sharp bents across its surface. The rear panel 306 extends to cover the rear and left and right sides of the container 300. The front edge of the rear panel 306 is coupled to the edge of the front panel 304. In one embodiment, the rear panel 306 is made of a general smooth (without structural seams, joints or sharp bents across its surface), thin sheet of metal, such as stainless steel or aluminum, which may be textured or coated or painted to provide a desirable finish. In the embodiment of FIG. 12, the rear panel 304 comprises a curved rear sub-panel 320 and flat side sub-panels 321 and 322. The base 302 has a generally planar, flat structure, supporting the bottom edge of the front panel 304 and the bottom edge of the rear panel. The base 302 may be made of a rigid plastic material, wood or metal. It may include sufficient material (e.g., a thick wooden structure) or a heavy material (e.g., metal weights), to provide a weighted base. For a thin, lightweight structure base 302 made of plastic, structural features 310, such as rips and the like as shown in FIG. 16 may be provided for reinforcement and improving additional structure integrity to the base 302.

In the particular embodiment shown in FIG. 12, it has structures that are somewhat opposite in materials as compared to the previously described embodiment of the container 20 illustrated by FIGS. 1–11. In the present embodiment, the base rear panel 306 is made from a thin sheet of stainless steel, the front panel 304 is made of a thin rigid plastic, and the base 302 is made of a rigid plastic, as compared to the previous embodiment, in which the front panel 40 is metal, and equivalent rear structure (comprising the side and rear panels 50, 60 and 70) is plastic. The previous embodiment is designed with the rear panel 50 as a mounting base against a vertical surface. In the present embodiment, it is designed to be free standing on the base 302, which can be rested on a horizontal surface.

The base 302, front panel 304 and rear panel 306 are assembled to form the structure of the container 300 using primarily groove fittings at the periphery of the plastic parts (i.e., the base 302 and the front panel 304) to receive the edges of the metal panel (i.e., the rear panel 306), similar to the assembly in the previous embodiment illustrated by FIGS. 1–11. Specifically, grooves 305 are provided along the periphery of the backside (the side not exposed to view in the final assembly of the container 300) of the plastic front panel 304, similar to 160 along the periphery of the plastic side panels 60 and 70 and the rear panel 50 in the earlier embodiment, as shown in FIG. 2. As exemplified in FIG. 15, the grooves 305 are adapted to receive edges of the metal rear panel 306, facilitating attaching the sides and top of the rear panel 306 to the front panel 302, much like the previous embodiment illustrated in FIGS. 11A and 11B. Similar grooves are provided at the periphery of the top of the base 302, which receives the bottom edges of the metal rear panel 306, facilitating attaching the bottom of the rear panel 306 to the base 302.

Figure 16:
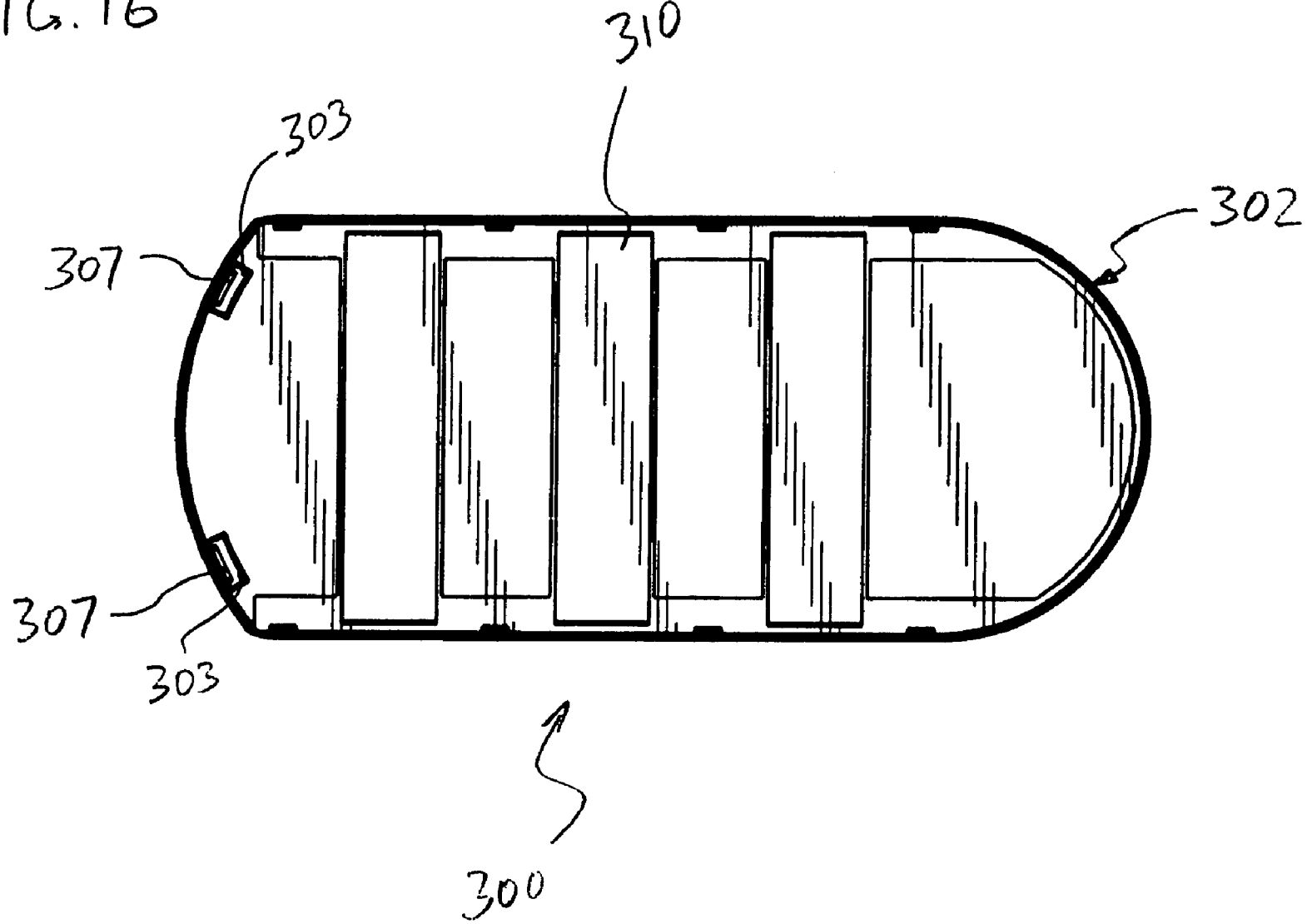
FIG. 16 is a bottom view of the container shown in FIG. 12.

Referring to FIG. 16, the bottom edge of the front panel 306 is attached to the front edge of the base 302 by clips 307 extending from the bottom edge of the front panel 306 through apertures 303 in the base 302. Each clip 307 has a hook end that latches onto the edge of the aperture 303, once the hook end of the clip 307 is inserted through the aperture 307. This sort of clip attachment is well known in the art for attaching plastic panels in a housing.

As can be seen from the foregoing description, the assembly of the container 300 can be quite simple, using essential three major components and a single fastener. The assembly process would include placing the bottom edge of the rear panel 304 in the mounting grooves along the top periphery of the base 302. The front panel 306 is assembled to the rear panel 304 by fitting the front and top edges of the rear panel 304 into the mounting grooves 305 at the periphery of the front panel 306. The front panel 306 is attached to the base 302 by inserting and locking the mounting clips 307 to the apertures 303 in the base 302.

The resultant assembly has the base 302, rear panel 304 and front panel 306 interlocked into a container structure, with the edges of the metal rear panel 304 retained in the groove in the front panel 306 and the base 302. This interlocking assembly may be sufficient to retain the structure of the container 300. To ensure the structural integrity of the assembly, referring to FIGS. 14 and 15, a fastener 314 is used to fasten the rear panel 304 to the front panel 306. The fastener 314 may be a screw (e.g., a self taping screw) that extends from through a hole 309 in the rear sub-panel 320 of the rear panel 304, and threads into a complementary anchor tab 316 at the top rear edge of the front panel 306. The resultant assembly is more resistant to user handling forces that might cause disassembly of the structural components. Other types of fastening structures may be adopted without departing from the scope and spirit of the present invention. For example, tab 316 may be structured with a clip to extend through and anchor a hole in the rear panel 304, or with an interference fit structure for attaching to a hole in the rear panel 304.

While the invention has been particularly shown and described with reference to the preferred embodiments, it will be understood by those skilled in the art that various changes in form and detail may be made without departing from the spirit, scope, and teaching of the invention. A person skilled in the art will recognize that the instrument incorporating the essence of this invention can also be used for storage of other types of collapsible items made from plastic or other soft and/or flexible materials. Accordingly, the disclosed invention is to be considered merely as illustrative and limited in scope only as specified in the appended claims.

We claim:

1. A container for storing and dispensing plastic bags, comprising:

a housing having at least one aperture for plastic bags, the housing comprising:

a generally smooth front panel defining a top section and a front section of the container, wherein the front panel has a unitary structure that defines a funnel-shaped aperture integral to the front panel, and wherein a wide end of the funnel-shaped aperture faces outwards of the housing and a narrow end faces inwards into the housing;

a rear panel having edges coupled to the front panel; and a base coupled to edges of the front panel and the rear panel.

2. The container of claim 1, wherein the front panel includes substantially rounded corners.

3. The container of claim 1, wherein the front panel includes no sharp bents.

4. The container of claim 1, wherein the front panel is made of plastic.

5. The container of claim 1, wherein the front panel further comprises an opening in the front section.

6. The container of claim 1, wherein the front panel includes grooves extending along the periphery of the front panel, the grooves adapted to receive side edges of the rear panel.

7. The container of claim 6, wherein the rear panel is coupled to the front panel by a single separate fastener.

8. The container of claim 7, wherein the fastener is a screw.

9. The container of claim 1, wherein the rear panel comprises a smooth structure defining rear and side sub-panels.

10. The container of claim 9, wherein the rear panel includes substantially rounded corners.

11. The container of claim 9, wherein the rear panel includes no sharp bents.

12. The container of claim 9, wherein the rear panel comprises a unitary structure defining a rear and two sides.

13. The container of claim 12, wherein the rear panel is made of metal.

14. The container of claim 9, wherein the front panel is one-piece made of plastic and the roar panel is one-piece made of metal.

15. A container for storing and dispensing plastic bags, comprising:

a housing defining a storage space; and the housing comprises a front panel having a unitary structure defining a funnel-shaped aperture for insertion of the plastic bags into the container, wherein a wide end of the aperture faces the outside of the container and a narrow end faces storage space.

16. A process of assembling a container for storing and dispensing plastic bags, comprising the following stops:

providing a generally smooth plastic front panel having a unitary structure that defines a funnel-shaped aperture integral to the front panel and grooves defined along its periphery;

providing a generally smooth metal rear panel comprising integral two sides and a rear;

providing a base having grooves defined along its periphery;

coupling front and top edges of the rear panel to the grooves in the front panel; and coupling the base to bottom edges of the front panel and bottom edges of the rear panel.

17. The process of claim 16, wherein the base is fastened to the bottom edge of the front panel by clip attachment.

18. The process of claim 17, wherein the base is provided with grooves to receive the bottom edges of the rear panel.

19. The process of claim 18, wherein the rear panel is fastened to the front panel using a single separate fastener.

* * * * *